US008958591B2

(12) United States Patent
Hagman

(10) Patent No.: US 8,958,591 B2
(45) Date of Patent: Feb. 17, 2015

(54) SPEAKER SYSTEM METHOD AND APPARATUS

(76) Inventor: Paul N. Hagman, Mount Vernon, WA (US)

( * ) Notice: Subject to any disclaimer, the term of this patent is extended or adjusted under 35 U.S.C. 154(b) by 365 days.

(21) Appl. No.: 13/331,913

(22) Filed: Dec. 20, 2011

(65) Prior Publication Data

US 2013/0156243 A1 Jun. 20, 2013

(51) Int. Cl.
*H04R 9/06* (2006.01)

(52) U.S. Cl.
USPC ..... 381/333; 381/337; 381/303; 381/162; 353/18

(58) Field of Classification Search
USPC ..... 381/89, 333, 334, 335, 80, 300, 301, 381/302, 303, 304, 305, 306, 308, 61, 98, 381/100, 152, 337, 351, 161, 162, 167; 353/15, 18, 19; 181/150, 199; 348/40, 348/14.07
See application file for complete search history.

(56) References Cited

U.S. PATENT DOCUMENTS

| | | | | |
|---|---|---|---|---|
| 3,164,221 | A * | 1/1965 | Rich | 181/163 |
| 3,636,281 | A | 1/1972 | Cozart | |
| 3,938,617 | A | 2/1976 | Forbes | |
| 4,484,658 | A | 11/1984 | Grote | |
| 4,903,300 | A | 2/1990 | Polk | |
| 4,923,032 | A | 5/1990 | Nuernberger | |
| 4,928,312 | A | 5/1990 | Hill | |
| 5,119,421 | A | 6/1992 | Reime | |
| 5,400,412 | A | 3/1995 | King, Sr. et al. | |
| 5,400,413 | A | 3/1995 | Kindel | |
| 5,539,835 | A | 7/1996 | Bertagni et al. | |
| 5,615,275 | A | 3/1997 | Bertagni et al. | |
| 5,693,917 | A | 12/1997 | Bertagni et al. | |
| 5,991,424 | A | 11/1999 | Bertagni et al. | |
| 6,154,555 | A | 11/2000 | Roark | |
| 6,351,542 | B2 * | 2/2002 | Azima et al. | 381/345 |
| 6,578,808 | B1 | 6/2003 | Bertagni et al. | |
| 7,292,702 | B2 | 11/2007 | Hagman | |
| 2007/0263081 | A1 * | 11/2007 | De Beer et al. | 348/14.08 |

FOREIGN PATENT DOCUMENTS

JP 2003019900 A * 1/2003

OTHER PUBLICATIONS

Komatex, "Technical Values.", pp. 1-2, 2007.

* cited by examiner

*Primary Examiner* — Leshui Zhang
(74) *Attorney, Agent, or Firm* — Dwayne E. Rogge; Schacht Law Office, Inc.

(57) ABSTRACT

The disclosure relates to several embodiments of a concealed speaker system, The concealed speaker system further has a speaker assembly mounted to the base frame and an active member which may be formed of PVC, expanded PVC, hardened fibrous materials, foam core, or equivalents that has an outer surface which in some embodiments is substantially coplanar with the surrounding wall section, and in other embodiments extends slightly outward therefrom. The base frame, speaker assembly, and the active member cooperate to form an acoustic chamber that is positioned behind the inner surface of the active member. Acoustic energy is transferred from the speaker assembly to the active member where the sound is produced therefrom to the room.

7 Claims, 17 Drawing Sheets

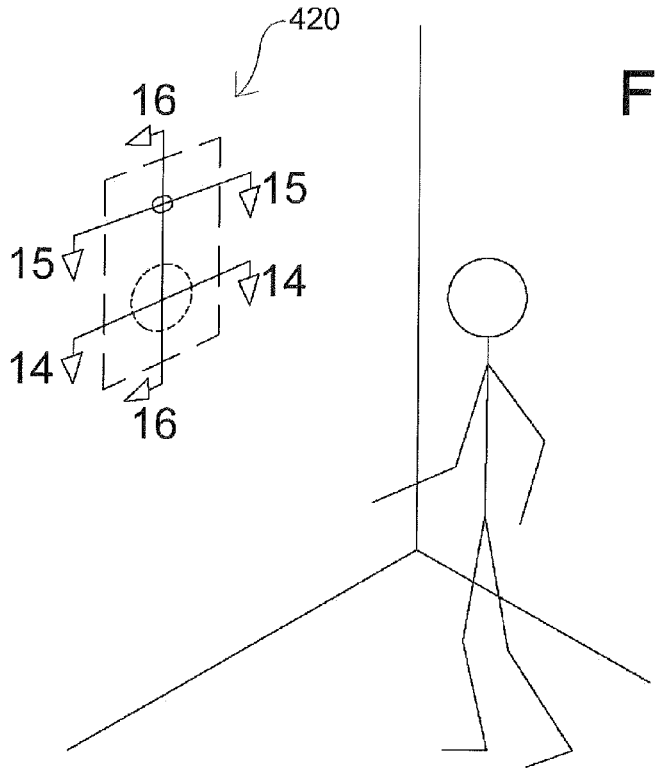
FIG. 13
FIG. 14
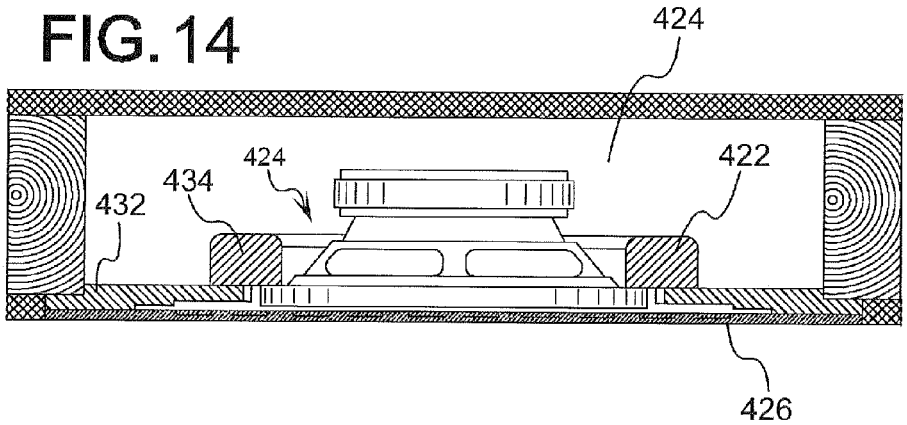
FIG. 15
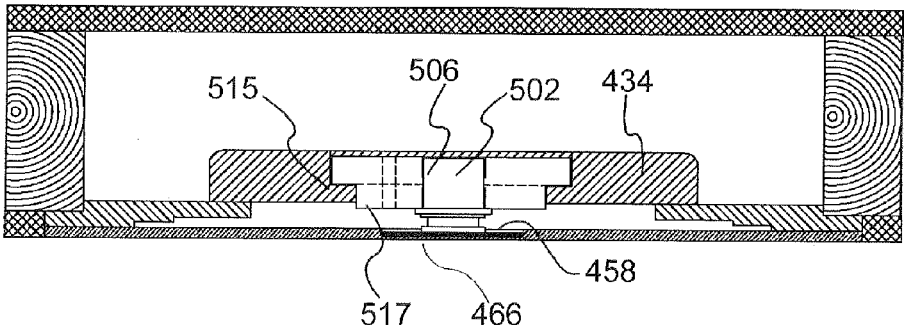

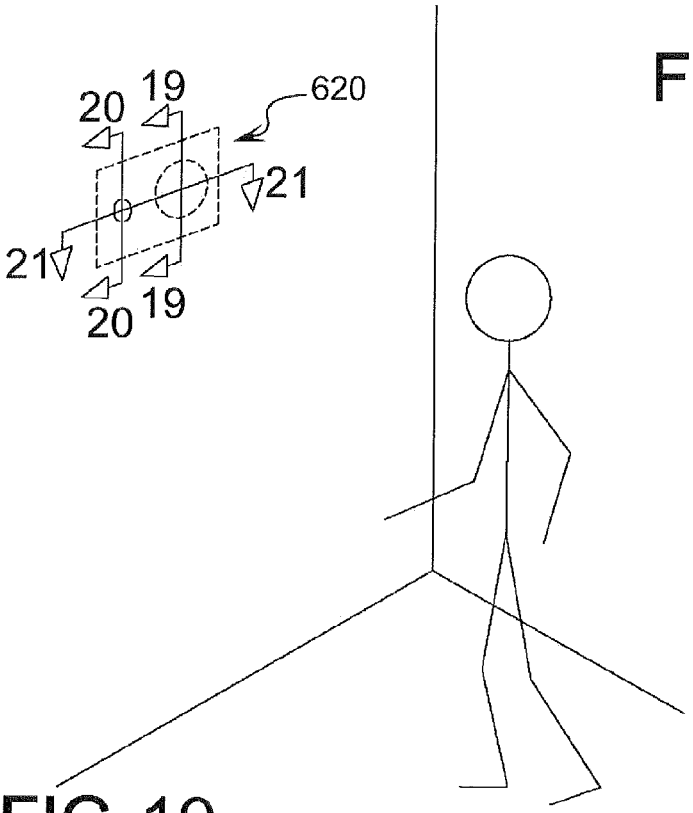
FIG. 18
FIG. 19
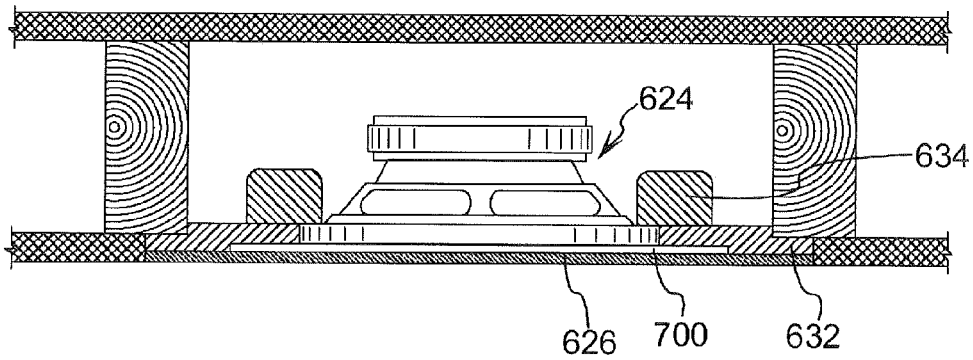
FIG. 20
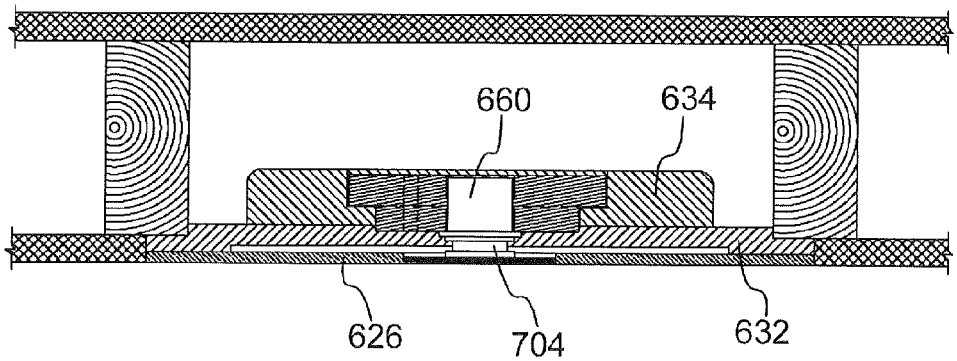

SPEAKER SYSTEM METHOD AND APPARATUS

RELATED APPLICATIONS

This application claims priority benefit of and is a continuation in part of U.S. Ser. No. 12/939,483, filed Nov. 4, 2010 incorporated herein by reference which claims priority in 10 turn to U.S. Pat. No. 7,292,702, filed Apr. 28, 2004, which claims priority benefit of U.S. Serial Provisional No. 60/525,514, filed Nov. 26, 2003, and U.S. Serial Provisional No. 60/466,461 filed Apr. 29, 2003. Each of these references is incorporated by reference.

SUMMARY OF THE DISCLOSURE

Speaker systems have been used in various installation assemblies in order to produce music. Often these systems use visually innocuous, free-standing speakers. The improved speakers themselves generally provide varying degrees of aesthetic value. The visually innocuous speakers must still accomplish their utilitarian function of producing quality sound. By removing the speaker assemblies from immediate view, the listener can direct their vision toward objects that are designed for aesthetic appeal while still enjoying music, speech reinforcement, or other sounds produced by the speaker device.

As disclosed below, this disclosure is directed to embodiments for an improved speaker system adapted to be concealed in a room. In one form, the speaker assembly is mounted to a base frame, and the speaker assembly has a speaker frame and a reciprocating portion attached to the speaker frame. The reciprocating portion has a driver and a cone portion mounted to the speaker frame, wherein the driver is adapted to move in response to an audio input signal.

There is also disclosed an active member formed from Polyvinyl Chloride (PVC) or expanded (foamed) PVC having a graphic image produced thereon. The active member may include a peripheral region connected to a base frame where the active member has an outward surface and an inward surface. The inward surface, the base frame and the speaker assembly, define an acoustic chamber, through which acoustic energy is transferred from the reciprocating member of the speaker to the active member so that the outward surface of the active member transmits the acoustic energy as sound to the room.

BRIEF DESCRIPTION OF THE DRAWINGS

FIG. 13 shows an environmental view where an in-wall speaker system is shown as a hatched line, where the speaker system is hidden from the view of a listener;

FIG. 14 is a partial cross sectional view taken at line 14-14 of FIG. 13 of a speaker assembly;

FIG. 15 is a full cross sectional view taken at line 15-15 of FIG. 13 of a speaker assembly;

FIG. 18 shows an environmental view where an improved in-wall speaker system is shown as a hatched line, where the speaker system is hidden from the view of a listener in a different orientation from that shown in FIG. 13;

FIG. 19 is a partial cross sectional view taken at line 19-19 in FIG. 18 of one embodiment of the disclosed speaker assembly;

FIG. 20 is a full cross sectional view taken at line 20-20 in FIG. 18 of one embodiment of the disclosed speaker assembly;

DESCRIPTION OF THE PREVIOUS EMBODIMENTS

There will first be a general discussion of the environment where the speaker system 20 can operate, followed by a detailed discussion of the various embodiments and improvements of the speaker system 20, including a free-standing embodiment, which in one form utilizes a novel material or materials for the front panel or active member 26. In one form, a graphic image is produced on the front panel, or active member. The previous embodiments are not exclusive of the improved embodiments, and add support thereto.

Figure 1:
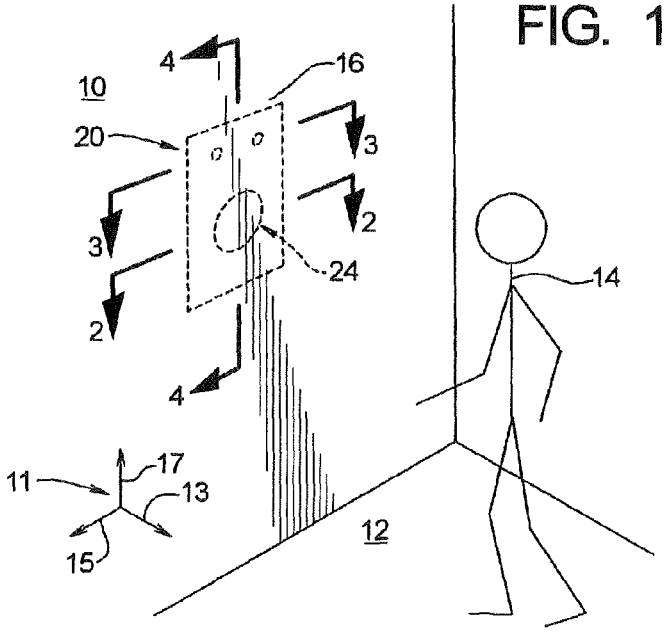
FIG. 1 shows an environmental view of one embodiment where an in-wall speaker system is shown as a hatched line wherein the speaker system is hidden from the view of a listener.

As shown in the embodiment of FIG. 1, a speaker system 20 is mounted substantially flush with a wall section 10 that is a portion of a room generally indicated at 12. While the speaker system may just as well be incorporated into or onto the surface of a floor, ceiling, or bulkhead, the term wall is used to encompass all such structures and equivalents. In operation, a listener 14 will hear the acoustic output of the speaker system 20 without being visually distracted by the source of the sound produced therefrom. The wall section 10 comprises a surrounding region generally indicated at 16. The surrounding region 16 indicates the general perimeter area around the in-wall embodiment of the speaker system 20. After a detailed discussion of the speaker system there will be a discussion of the installation and various installation options of several embodiments. To aid the general description, as shown in FIG. 1, an axes system 11 is utilized where the arrow indicated at 13 indicates a longitudinal axis, the arrow 15 generally indicates a lateral axis and the arrow indicated at 17 indicates a vertical axis. The axes denote general directions and are in no way intended to limit the disclosure to any specific orientation, but they rather aid in the description of the components discussed herein.

Figure 5:
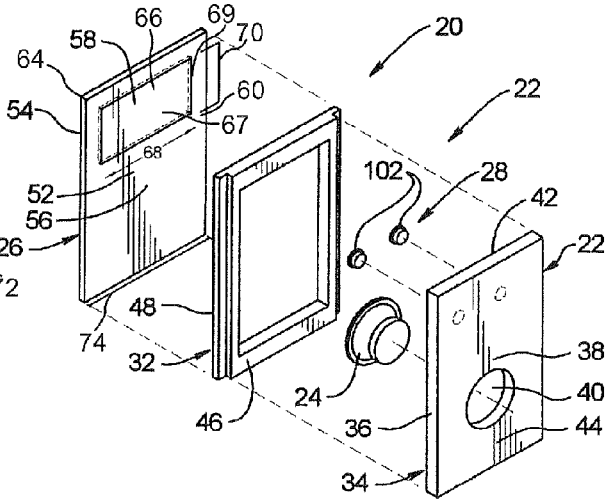
FIG. 5 shows an exploded view of an embodiment of the disclosed speaker system.
Figure 6A:
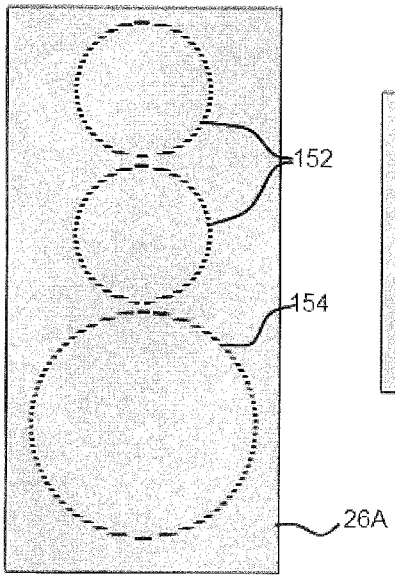
FIGS. 6A-6F show highly schematic views of six different arrangements of speaker drivers relative to the active member.
Figure 6B:
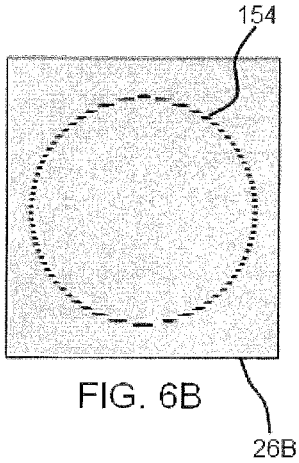
Figure 6C:
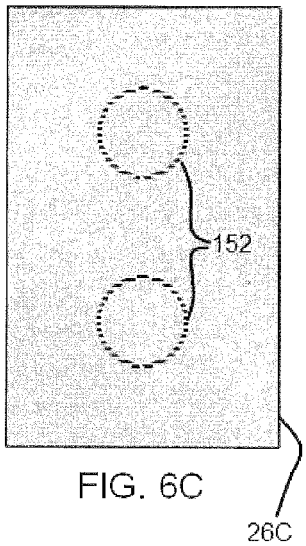
Figure 6E:
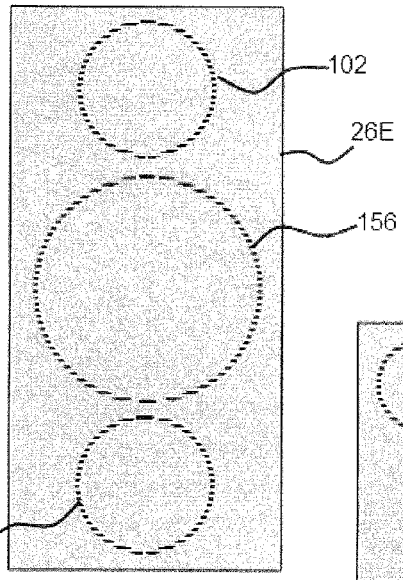
Figure 6D:
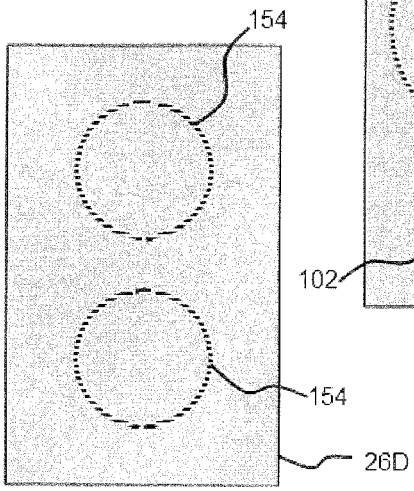
Figure 6F:
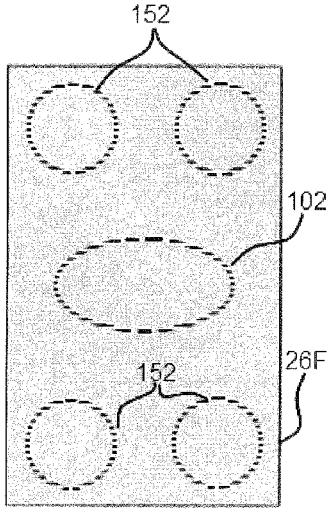

Now referring to the embodiment of FIG. 5, the speaker system 20 comprises a base frame 22, a speaker assembly 24 and an active member 26. Further, a high-frequency system 28 may be employed that is adapted to better produce/transmit higher frequency sounds.

Figure 2:
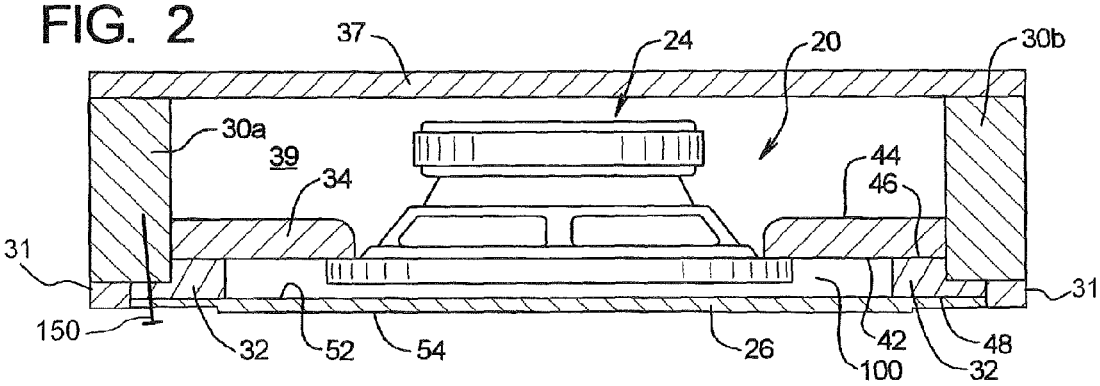
FIG. 2 is a partial cross sectional view taken at line 2-2 in FIG. 1 of one embodiment of the speaker assembly.

Referring to the embodiment of FIG. 2, an in-wall embodiment of the speaker system is shown installed between support members 30*a* and 30*b*. The support members in this embodiment generally are wall studs, or other structural framework, made of wood or metal and generally spaced at or about 16 inches laterally from one-another. In one in-wall form, the speaker system 20 can be retrofitted to an existing wall installation, and in one form dry wall such as prefabricated (sheet rock) panels may be positioned on top of vertical support members, such as those shown at 30*a* and 30*b*. In a retrofit situation, a portion of the dry wall may be removed and the in-wall speaker system 20 positioned in the location of the removed dry wall. Thereafter, traditional dry wall techniques, such as spackling, can be applied to the perimeter region to smooth the transition from the surrounding wall section 16 (see FIG. 1) and the active member 26. The in-wall speaker system 20 can also be installed during a dry wall installation where the installers provide for an open region that corresponds to the approximate size of the in-wall speaker system 20. After the in-wall embodiments are installed, spackling, paint, or equivalent materials may be applied to the perimeter region to smooth the transition between the surrounding wall section and the active member. The active member 24 in several forms is adapted to have paint applied to at least the edge thereof to hide the active member(s) from sight of individuals 14 listening to music.

There will now be a discussion of the components of the speaker system 20 shown in FIG. 5. The base frame 22 in one form comprises a perimeter frame 32 and a rear baffle 34, although these portions may be constructed out of a unitary structure. In one form, the base frame is cast (machined) from a polymeric material. The rear baffle 34 has a perimeter region 36 and a central region 38. In one form, located in the lower central region, there is a surface defining an open area 40 having a perimeter region that is adapted to mount the speaker assembly 24 thereto. The perimeter frame 32 in one form has a rearward perimeter surface 46 that is adapted to mount to the forward surface 42 of the rear baffle 34. The perimeter frame 32 further has a forward perimeter surface 48 that is adapted to mount adjacent to on in contact with to the perimeter region of the active member 26 described further below. As shown in the lower portion of FIG. 4, the perimeter frame 32 has a longitudinal thickness 50 that is such to define a proper spacing between the forward surface 42 of the rear baffle 34 and the inner surface 52 of the active member 26. The significance of the spacing is described further below.

There will now be a discussion of the active member 26 followed by a discussion of the speaker assembly 24 and the high-frequency system 28. As shown in FIG. 5, the active member 26 has a rearward surface 52 (also referred to an inner surface) and a forward surface 54 (also referred to as the outer surface). As shown in FIG. 5, the rearward surface 52 in this embodiment has a low-frequency-reciprocating region 56 and a high-frequency region 58. The high-frequency surface interoperates with a portion of the high-frequency system 28 along with the high frequency elements described further below. The reciprocating area can be described as comprising a low-frequency reciprocating area and a high-frequency reciprocating area. The low-frequency reciprocating area is the general area of the active member 26 that vibrates to produce lower frequency sounds adjacent the speaker assembly 24. This area can be a portion of the high-frequency region 58 where the higher frequency vibrations vibrate on top of the lower frequency vibrations. In other words, while the active member 26 is vibrating to produce lower frequency sound in the low-frequency region, the high-frequency region 58 can be additionally vibrating at a higher frequency to produce additional sound vibrations without negatively affecting the high frequency region. The high-frequency reciprocating area is generally located at the high-frequency region 58. Because the high frequencies generally have less travel in the longitudinal direction, the high-frequency reciprocating area can be of a much smaller surface area than the low-frequency reciprocating area. For example, as shown in FIG. 6A-6F, the driver portions of the high-frequency elements 102 create a localized high-frequency reciprocating area where the rearward portions of the high frequency system 28 are attached to the high-frequency non-reciprocating areas which can be portions of the base frame. However, the high-frequency non-reciprocating areas still may be a portion of the low-frequency reciprocating area. The non-reciprocating areas may not produce as much sound, or none at all for the respective frequency ranges.

The active member 26 in one form comprises a PVC layer 64. This PVC layer, or expanded PVC layer provides the requisite rigidity and moderate flexibility to handle the acoustic coupling of the acoustic chamber 100 discussed further herein. Previous paper-backed foam-core panels responded poorly to moisture present in some environments and in some construction methods, resulting in deforming of the panel. In addition, the foam core panels in some environments were prone to damage, such as finger dents, during installation. The PVC or expanded PVC panels have been found to be not only more resistant to moisture, but they have shown the unexpected result of better acoustics and a dramatic improvement in acoustic fidelity. The thickness of the active member can be between 1/16 of an inch to 5/8 of an inch, or more specifically, a thickness of 2/16 of an inch to 5/16 of an inch. The applicant has been successful with a PVC/Expanded PVC active member 26 that is 3/16 of an inch thick.

Figure 10:
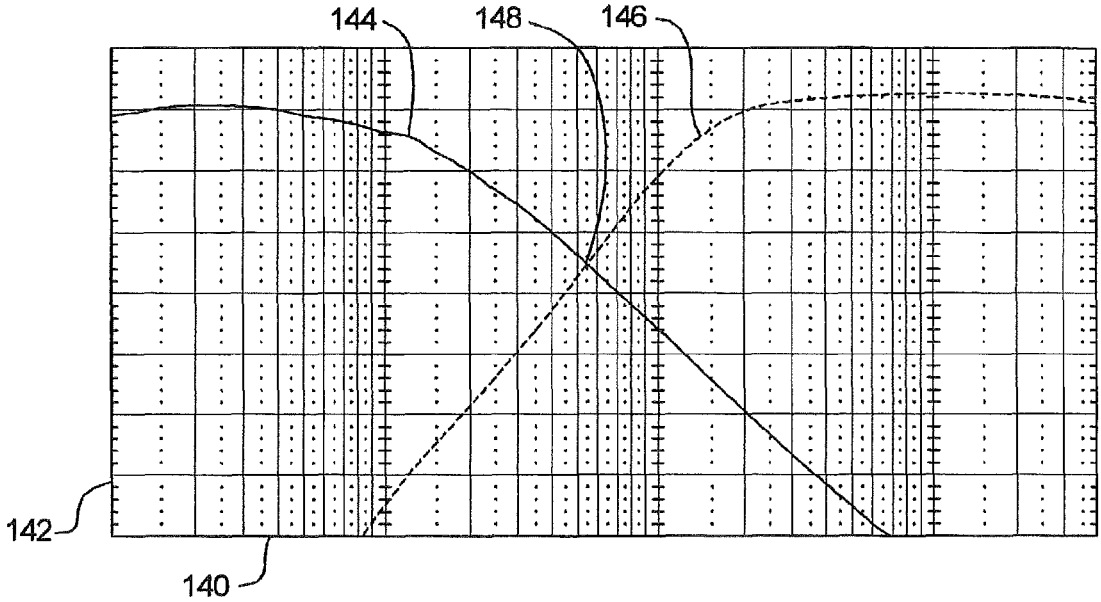
FIG. 10 is a logarithmic graph showing a crossover.
Figure 10A:
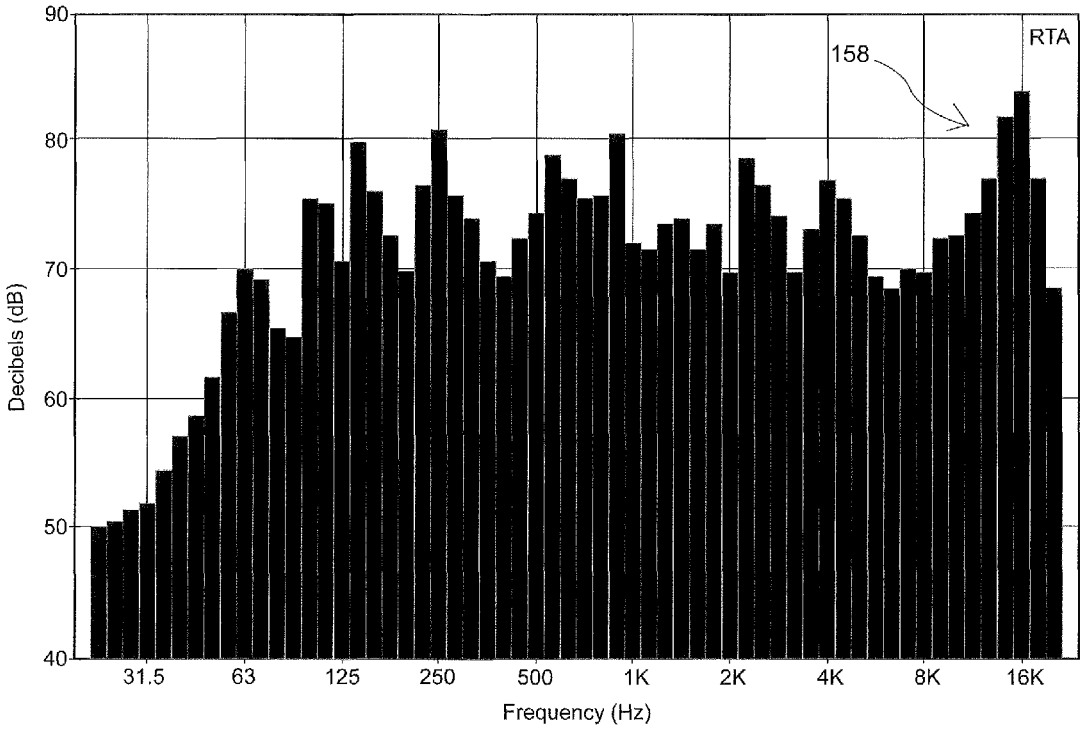
FIG. 10A is a chart of the frequency response of a speaker system utilizing a foam core active member.
Figure 10B:
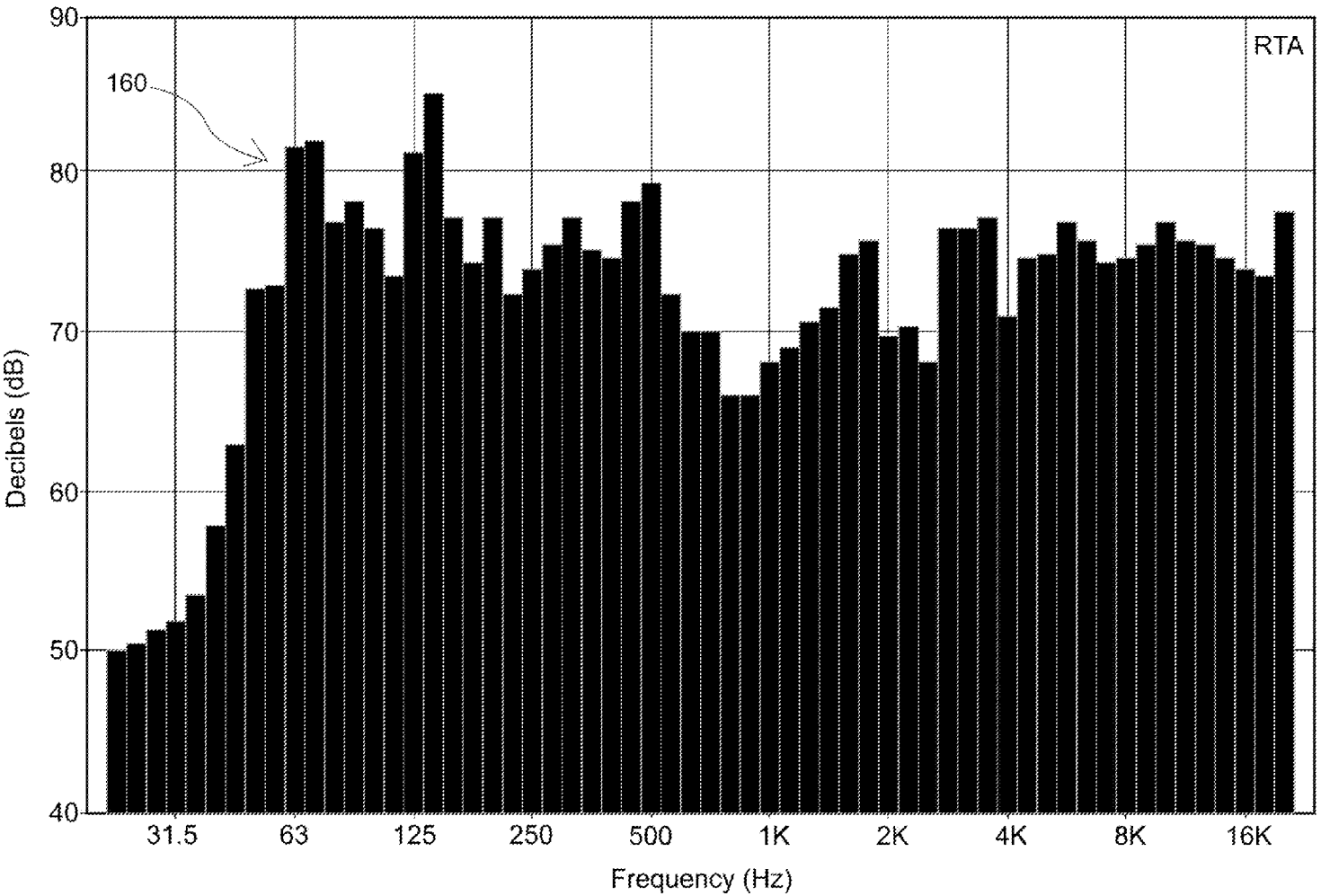
FIG. 10B is a chart of the frequency response of a speaker system utilizing a PVC active member.

Comparing FIG. 10A to FIG. 10B, one can see how a frequency response of a speaker assembly using a foam core panel, as shown in FIG. 10A, has a dramatic spike 158 in the vocal range between a frequencies of 8K Hz and 16K Hz.

Using a PVC panel as depicted in FIG. 10B, a similar spike 160 is shown at about 63 Hz; tests have shown this to be at about 67 Hz for the material tested, and the panel size did not significantly change the response rate.

In one form of making the high-frequency region 58 as shown in FIG. 5, a portion of the inner surface 60 may be removed as well as a certain amount of depth of the PVC structure 64. Thereafter, a high-frequency plate 66 may be inserted in the open area of removed material. The high-frequency plate 66 has a high-frequency inward surface 67 and a perimeter region 69 that surrounds the perimeter of the high-frequency inward surface 67. The high-frequency plate 66 in one form is relatively thin, rigid, firm and adapted to resonate at higher frequencies. In one form, resonate frequencies between the broad range of 400-20,000 hertz and a more focused range of 500-14,000 hertz are used. A further focused vibration range for the high-frequency plate 66 is between 800-12,000 hertz. In one form, the high-frequency plate 66 is formed of a rigid composite material, such as carbon fiber, and may be made circular, oval, square, or other desired shapes to follow a particular application.

Figure 3:
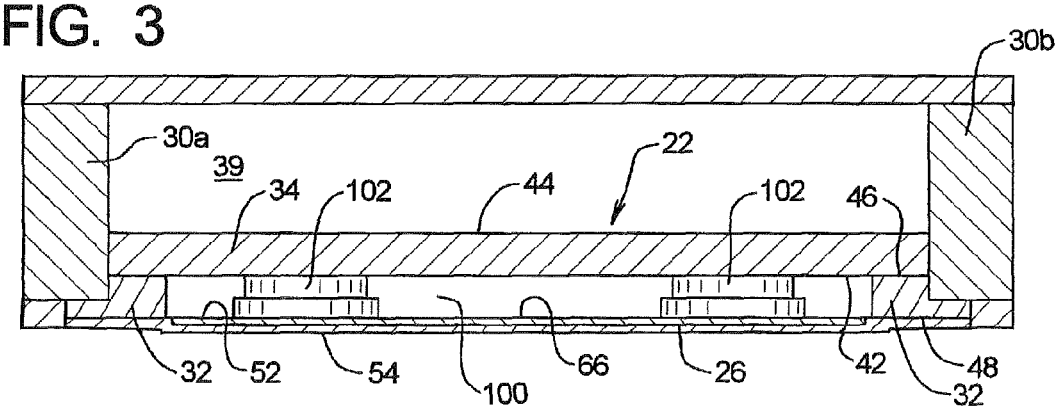
FIG. 3 shows a partial cross sectional view of one embodiment of the high-frequency region where high-frequency elements are connected to the reciprocating area on the active member of the high-frequency region taken along line 3-3 of FIG. 1.

As shown in FIG. 5, the high-frequency plate 66 when utilized has a lateral width of the dimension 68 and a height dimension 70. Further, the active member 26 has a vertical dimension indicated at 72 and a width dimension indicated at 74. In most in-wall installations, the width dimension 74 of the active member is larger than the width between the support members 30*a* and 30*b*, as seen in FIGS. 2-3, so that in some in-wall installations the fasteners 150 may pass through the active member and into the support member 30. In general, the difference between the width 74 of the active member 26 and the width 68 is such to allow for a perimeter spacing region so the perimeter region of the active member 26 can mount to the forward perimeter surface 48 of the perimeter frame 32 and to isolate active member 26 from perimeter region. In one form, the active member 26 has a forward surface 54 that is a wood sheet veneer approximately 0.020 inch thick.

The central region of the high-frequency inward surface in one form is adapted to resonate to produce a majority of the sound transmitted through the high-frequency region 58. This arrangement allows the high-frequency reciprocating region to double as the low-frequency reciprocating region where there is a frequency overlay and the high-frequency vibrations of the high-frequency plate 66 occur in conjunction with the low-frequency vibrations of the whole active member 26.

Figure 2A:
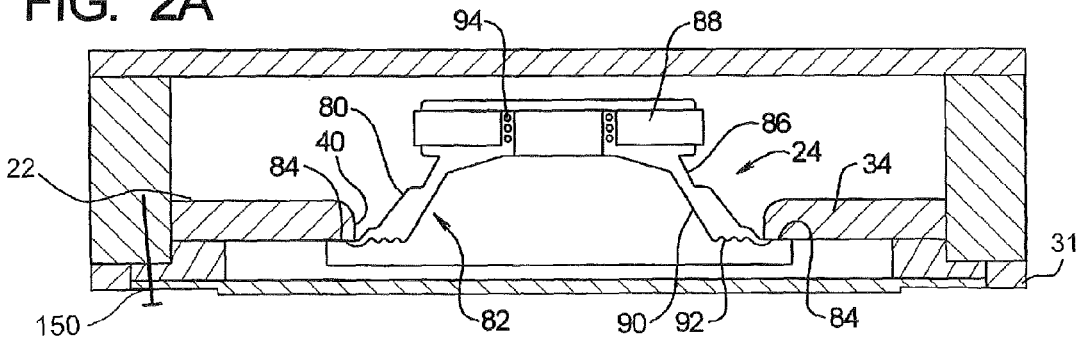
FIG. 2A is a full cross sectional view taken at line 2-2 in FIG. 1 of the speaker assembly.

There will now be a discussion of one form of the speaker assembly with reference to FIG. 2A. As shown, the speaker assembly 24 comprises a speaker frame 80 and a reciprocating portion 82. The speaker frame 80 in one form has a guide commonly referred to as a spider, a first perimeter region 84 that is adapted to mount to the open area 40. In one form the speaker frame is part of the rear baffle 34 and the reciprocating portion 82 may be directly mounted thereto. The second perimeter region 86 in one form is adapted to mount to a static permanent magnet 88. The permanent magnet 88 provides a field of magnetic force from the outer magnet portion to the inner concentric portion.

The reciprocating portion 82 in one form comprises a cone 90, a surround 92 and a voice coil 94. The voice coil is adapted to reposition in the longitudinal direction with respect to the current flowing therethrough. The voice coil in turn repositions the cone 90 to displace air and create sound. The operational element of the reciprocating portion attached to the speaker frame is to displace air at desirable frequencies to produce sound from an electric input wave. The reciprocating portion 82 is defined broadly to encompass any air-moving device that displaces air or other gas in order to create sound or otherwise change the pressure within the acoustic chamber 100 to vibrate the active member 26, thus producing sound. The reciprocating portion 82 in a conventional form is a conventional speaker that can be retrofitted to the open area 40. However, other types of air displacing and pressure varying devices suitable for this application can be employed.

Figure 4:
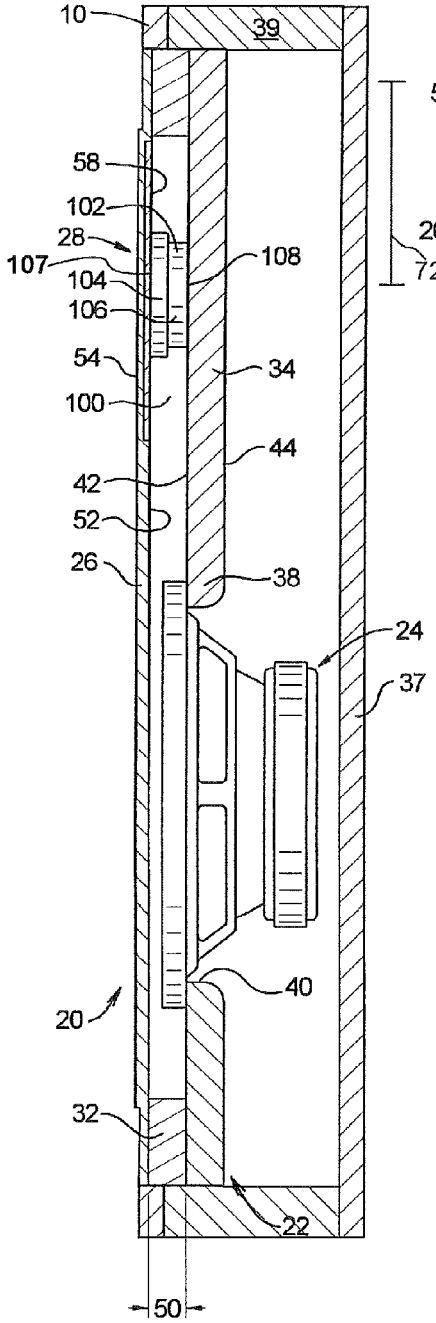
FIG. 4 shows a side partial cross sectional view of the disclosed speaker system taken along line 4-4 of FIG. 1.

Therefore, an acoustic chamber 100 is in one form defined between the inward surface 52 of the active member 26, the base frame 22 in the speaker assembly 24. The acoustic chamber is adapted to transfer acoustic energy from the reciprocating portion 82 of the speaker assembly 24 to the active member 26. The active member thereby transfers the acoustic energy (vibration) to the surrounding room 12 as shown in FIG. 1. The distance 50 as shown in FIG. 4 is kept to a minimum so the volume of the acoustic chamber is minimized such that the capacitance effect is lowered and the transfer of energy is greater.

There will now be a discussion of one high-frequency system. This high-frequency system comprises the high-frequency region 58 and the high-frequency elements 102 that are shown in FIG. 4. Other drivers that respond to higher frequency input signals can be employed. The high-frequency elements 102 comprise a driver portion 104 and a base region 106. The base region 106 has a rear surface 108 that may be mounted to the base frame 22. Spacers can be employed so the overall longitudinal depth of the high-frequency elements 102 is substantially equal to distance 50.

Mounting the base region 106 of the high-frequency elements 102 to the base frame 22 may be accomplished by attaching the base region 106 to a substantially non-reciprocating portion of the inner wall speaker system 20. As shown in FIGS. 4 and 5, one method of effectively mounting the base region 106 of the high-frequency elements 102 to the base frame 22 is achieved by directly coupling the rear surface 108 to the forward surface 42 of the rear baffle 34. The non-reciprocating portions of the active member 26 may be positioned around the perimeter region near where the active member 26 is connected to the perimeter frame 32. The central region of the rearward surface 52 of the active member 26 may reciprocate and oscillate greater than the perimeter regions of the same.

In one form, a high frequency plate 66 or equivalent is adhered to the inner surface of the active member 26, which is in turn adhered to the front edge 107 of the high frequency element 102. In one form, the high frequency plate 66 as previously described is formed of a rigid material, such as carbon fiber, fiberglass, polymer laminate, or equivalents. Especially in the embodiments where a hardened fibrous material is used for the active member, the high frequency plate may be omitted. The terms fiberglass and carbon fiber used herein are not references to the pliable fabric-like material in its raw state, but usually refer to the material combined with a resin and hardener, epoxy, or equivalent. Once combined, the fibrous material combines with the resin and hardener to form a rigid material common to boats, automobiles, and other uses.

It can therefore be appreciated that in at least one form, the lower frequencies are generated by an acoustic coupling between the speaker assembly 24 and the active member 26 via the acoustic chamber 100. However, the higher frequency sounds are generated by the high-frequency system 28 in one form by a direct drive type system where the driver portion 104 of the high-frequency element 102 directly reciprocates a high-frequency region 58 of the active member 26. It should further be noted that in one form, the high-frequency region 58 is located on a portion of the active member 26 which may be continuous with the low-frequency reciprocating region 56 of the active member 26. Other forms of the disclosure can be employed where the high-frequency region 58 is separated from the low-frequency reciprocating region 56.

Figure 9:
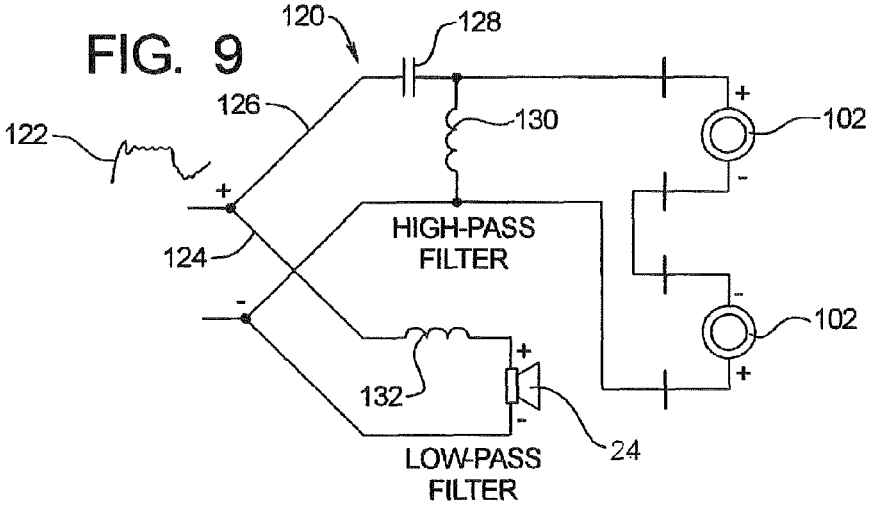
FIG. 9 is a schematic view of an electronic circuit that can be employed in the speaker system.

Now referring ahead to the embodiment shown in FIG. 9, a crossover circuit 120 is shown that is adapted to send the higher frequency signals to the high-frequency system 28 and the lower frequency signals to the speaker system 24. The circuit 120 in operation has an input signal 122 sent to lines 124 and 126 where a capacitor 128, inductor 130 and an inductor 132 are employed to separate the frequency ranges of the incoming signal 122. The high-frequency elements 102 in this embodiment are positioned in series where the capacitor 128 is adapted to allow the higher frequencies to pass to these elements. The inductor 132 will filter out the higher frequencies so the speaker assembly 24 will only receive lower frequency signals.

In one tested example, the inner wall speaker system using a foam core active member had a peak frequency response (resonance frequency) of about 500 hertz. Foam core or Foam board is a very strong, lightweight and easily cut material used for the mounting of photographic prints, as backing in picture framing, in 3D design, and in painting. It is also in a material category referred to as "Paper-faced Foam Board". It normally consists of three layers—an inner layer of polystyrene clad with outer facing of either a white clay coated paper or brown Kraft paper. This frequency response was problematic when music was placed through the in-wall speaker system 20 because the vocal range, or a portion of it, is roughly 500 hertz. Therefore, the passive crossover circuitry as shown in FIG. 9 was incorporated to deliver a proper frequency distribution to the speaker assembly 24 and the high-frequency elements 102.

Using an active member formed of PVC or expanded PVC has been found to have an unexpected result, in that the PVC active member has been found to have a peak frequency response of about 67 hertz regardless of the panel size, which is outside the normal vocal range. The improved speaker system using a PVC or expanded PVC panel cleans up the vocal response of the assembly, resulting in a much more pleasing sound. A crossover circuit, either single or multiple stage may also be utilized to further avoid the resonance frequency of the apparatus.

In one form, as shown in FIG. 10, there is a logarithmic graph indicating the frequencies on the x-axis 140 and the gain indicated on the y-axis 142. The line 144 indicates the gain with respect to the frequency that is sent to the speaker assembly 26. The line 146 indicates the gain with respect to the frequencies that are sent to the high-frequency system 28. The crossover point 148 is the acoustic peak point and the parameters of the circuit in FIG. 9 may be adjusted by one skilled in the art. As mentioned above, in one form, the frequency response of the speaker system 20 has been found to be approximately 500 hertz. Therefore, the crossover point 148 would be set to this frequency response. In a broader range, such frequency response can be between 300-1200 hertz.

Figure 7:
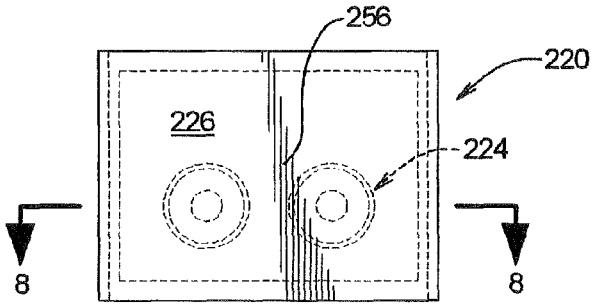
FIG. 7 shows a front view of another embodiment of the speaker system where two speaker assemblies are employed.
Figure 8:
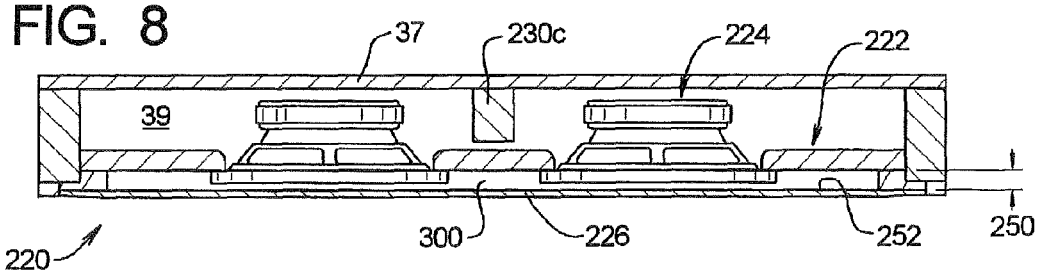
FIG. 8 is a partial top cross sectional view of the embodiment of the speaker system taken at line 8-8 of FIG. 7.

Now referring to FIGS. 7 and 8, there is shown an embodiment where similar components having similar numerals are designated the same as previous embodiments except increased by a value of two hundred (e.g. 20→220). As shown in this embodiment, the speaker system 220 comprises a base frame 222, a speaker assembly 224 and an active member 226. The speaker assembly 220 is substantially similar to the previous embodiments except the speaker assembly comprises two speaker systems to displace sound in the acoustic chamber 300. As shown in FIG. 8, an embodiment is conceived where the support member 230*c* is shortened in the longitudinal direction to account for the base frame 222. In a retrofit in-wall application, a portion of the support member 230*c* can be removed or, when constructing a new wall, the support member 230*c* can be fitted as a smaller unit at that time. Alternatively the support member 230*c* is rotated 90° so the narrower portion extends longitudinally to fit the in-wall speaker system 220 in the wall section.

Because the lateral width of the reciprocating region 256 is greater in this embodiment, there is potential for a greater reciprocating motion. Therefore, the active element 226 can vibrate at a greater distance in the longitudinal direction. The distance between the rearward surface 252 of the active member and the forward surface of the base frame 222 indicated at 250 should be set accordingly so the inner surface 252 does not come in contact with the inner portions of the acoustic chamber 300, such as the speaker assemblies 224.

The various components of this embodiment of the speaker system 220 are similar to the embodiments described above. A high-frequency system similar to the high-frequency system 28 above can be employed in the embodiments shown in FIGS. 7 and 8. In one form, the speaker system 220 as shown in FIGS. 7 and 8 can be employed in conjunction with the speaker system 20 shown above. For example, as shown in FIG. 1, the speaker system 20 can be one of a plurality of systems placed at various locations in a room 12. The in-wall speaker system 220 may be utilized in conjunction with free-standing or non in-wall systems. It has been found advantageous in some applications to position the speaker system 220 at a lower elevation than the systems shown in previous figures for reasons to be explained below. It has also been found that the particularly large surface area of the active member 226 is conducive for producing higher amplitude bass frequencies.

As shown in FIGS. 2, 3, 4, and 8, a rearward wall 37 may be positioned rearward of the in-wall speaker system 20 in built-in applications. In freestanding applications, such as those shown in FIGS. 23-25, the rear panel 837 serves a similar purpose. The speaker assembly 24 of the in-wall application is such that it can conveniently fit between the surrounding wall section 10 and the rearward wall 37. This distance is normally between 1 and 10 inches and, in a narrower range, between 3 and 4 inches. The rearward wall 37 defines an open chamber 39 that is preferably of a large volume to minimize resistance of the motion of the reciprocating portion 82 of the speaker assembly 24 (see FIG. 2A).

In some installations of in-wall assemblies, the speaker system 20 is positioned approximately 6 feet above the floor or higher. This spacing allows for pictures or the like to be hung on the wall below the speaker system 20 and to not substantially interfere with sound quality. When installing the speaker system 20, adhesive fiberglass mesh drywall joint tape or equivalents can be used to bridge the gap between the perimeter frame and the surrounding wall. The acoustic performance of the assembly 20 could vary depending upon the installation and the exterior coating on the panel 26. A frequency tuner (graphic equalizer) can be employed to compensate for frequency damping at any particular range.

Figure 3A:
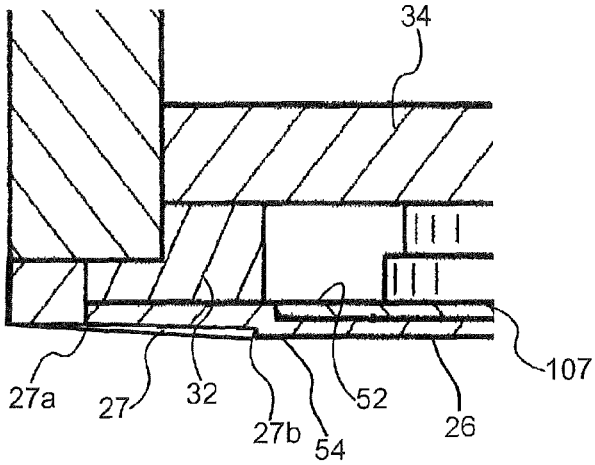
FIG. 3A shows a top cutaway detail view of an improved speaker assembly installed in a wall.

In one form of installation, as shown in FIGS. 2, 3, 4 and 8, the central region of the active member is slightly displaced longitudinally outward from the surrounding wall section 10 as shown in FIG. 3A. This extrusion forms an edge 27*b* which is advantageous because the edge 27*b* guides the installer to stop spackling at the perimeter region of the active member 26 and not spackle over the reciprocating portion of the active member. In addition, as best shown in FIG. 3A, the edge of the active member 26 may comprise a rabbet 27 having a face 27*a* and an edge 27*b*. Thus, a layer of tape and spackling can be affixed covering the rabbet 27 and a portion of the adjacent structure overlapping the gap therebetween using methods and materials well known in the field of wall structures. The edge 27*b* provides a alignment tool for the installer to use to align the tape and/or spackling. This is advantageous because less material would then be positioned on the reciprocating area of the active member 26. In one form, shown best in FIG. 3, the outer surface 54 of the active member 26 can extend outwardly between 1/32 of an inch up to 3/4 of an inch. A more specific range of the outward projection of the active member 26 is between 1/16 of an inch to 1/8 of an inch beyond the face of the adjacent wall surface. These ranges allow the outer surface 54, particularly the face 27*a* of the rabbet 27, to be substantially in line with the surrounding wall sections 10. Of course it is conceived to have the outer surface 54 to be directly coplanar with the surrounding wall section or sunken therein as the circumstances call for.

Figure 11:
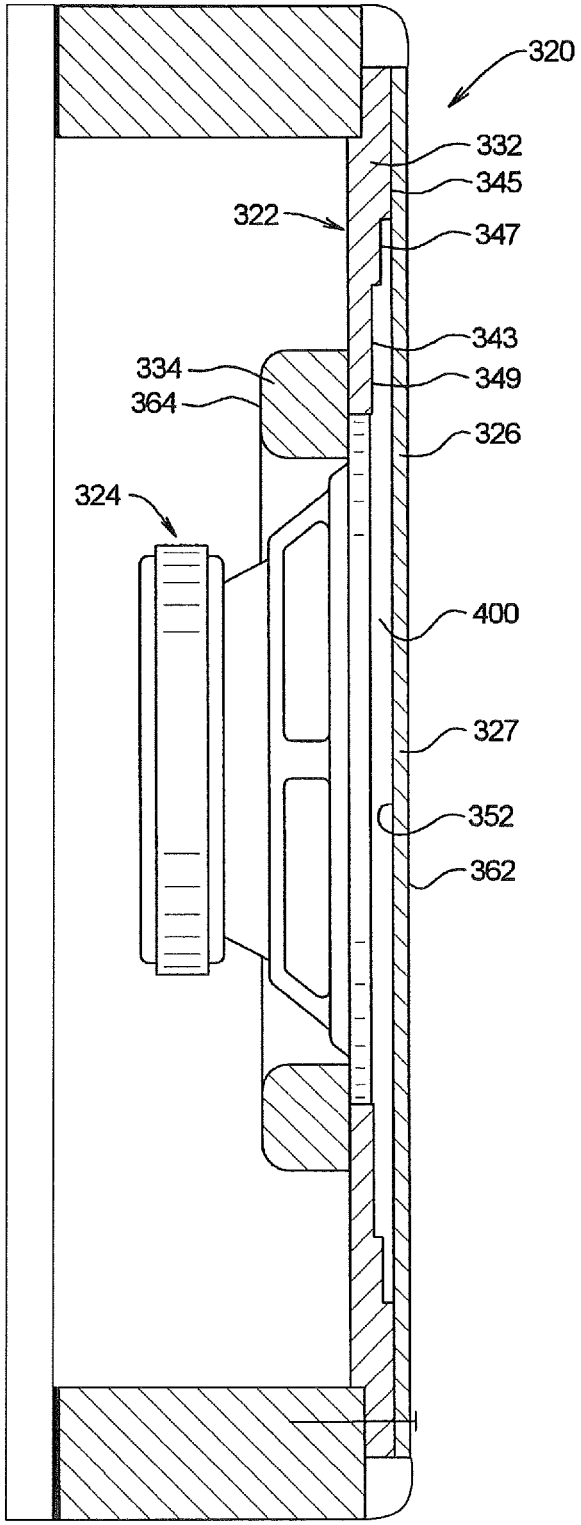
FIG. 11 shows a top partial cross sectional view of another embodiment of the speaker system.
Figure 12:
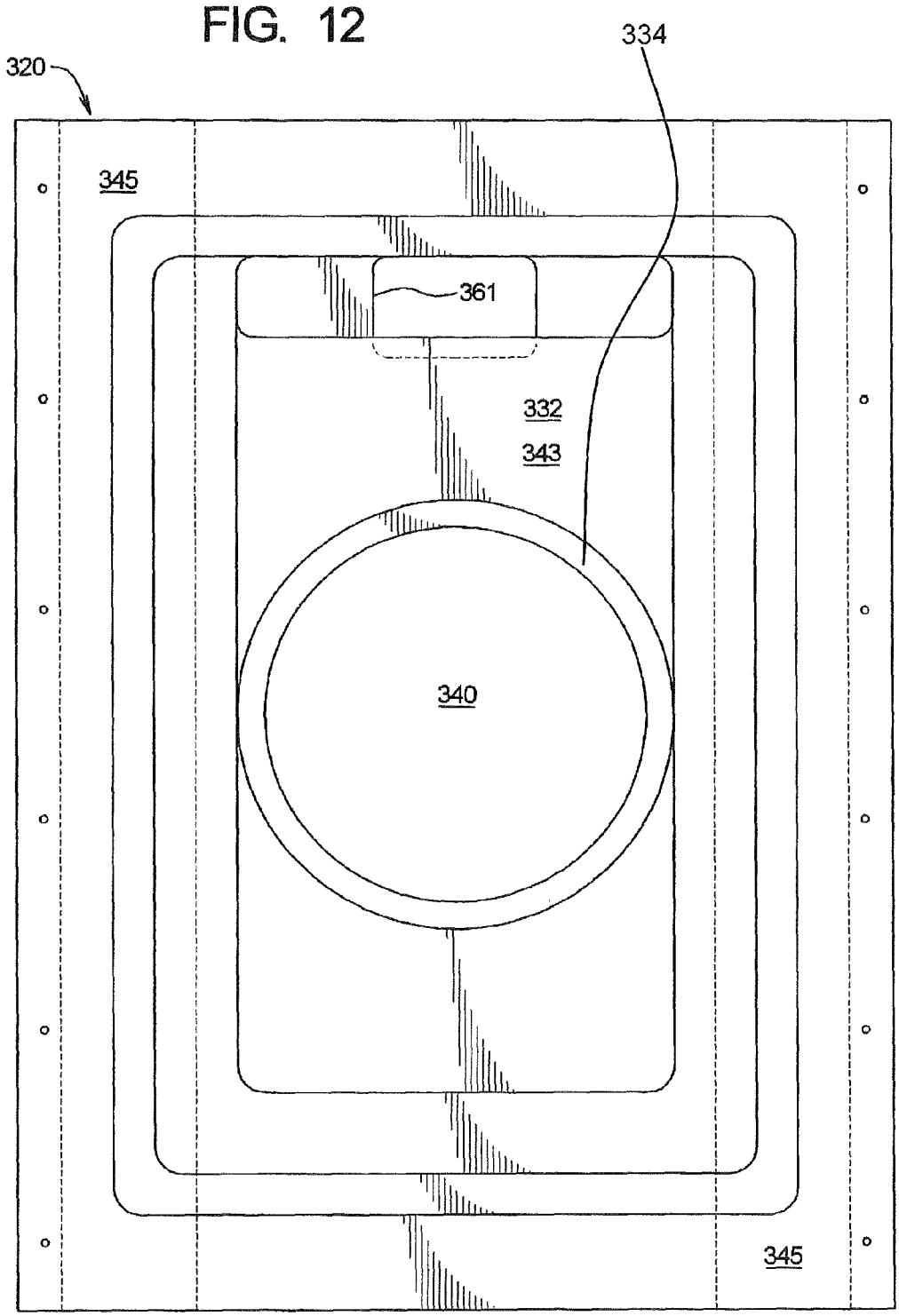
FIG. 12 is a front view of another embodiment of the disclosed speaker system.

Now referring to FIGS. 11-12, there is another embodiment of the speaker system 320 which comprises a base frame 322, a speaker assembly 324 and an active member 326. As in previous embodiments, to ease in understanding, similar components having similar numerals are designated the same except increased by a value of three hundred (e.g. 20→320). The embodiment as shown in FIGS. 11-12 is substantially similar to the previous embodiments, but the perimeter frame 332 wherein the forward surface 343 is such that it comprises a step down tier system whereby the surface 343 comprises a perimeter engagement surface 345 that is adapted to engage the rearward surface 352 of the active member 326. The surface 343 comprises progressive step-down sections 347 and 349 that in one form can be milled out of the perimeter frame 332. This surface arrangement is advantageous because the progressive repositioned surface in the longitudinally rearward direction accommodates the natural displacement of the active member 326 when in use. In other words, the center portion 327 of the active member will displace the greatest distance in the longitudinal direction. Therefore, in order to keep the acoustic chamber 400 to a minimal volume, a progressively stepped or slanted surface minimizes the volume of the acoustic chamber 400 and does not interfere or come in contact with the rearward surface 352 of the active member 326.

The embodiments as shown in FIGS. 11-12 further illustrate alternative proportions for the perimeter frame 332 and the rear baffle 334. As shown in FIG. 12, there is shown a front view of the speaker assembly 320 with the active member 326 and speaker assembly 324 removed to show the other components. The rear baffle 334 defines the open area 340 where the speaker assembly 324 as shown in FIG. 11 is adapted to be fitted therein. Located in the upper portion in FIG. 12 is an opening defined by a surface 361 of the rear baffle 334. A high-frequency element such as that as the elements 102 shown in FIGS. 4-5 is to be employed where it is positioned in the open area defined by the surface 361 and the driver portion 104 of these elements is fixedly attached to the rearward surface 352 of the active member 326. One or more high-frequency elements 102, mid-frequency elements 152, low frequency elements 154, and/or multi-frequency elements 156 can be employed, as shown for example in FIG. 6A-6F. A back plate (not shown) may be used to engage the base region such as a base region 106 in the previous embodiments whereby the back plate is rigidly attached to the base frame 322. As can be seen in FIG. 11, the rearward surface 364 of the rear baffle 334 is a sufficient distance from the inward surface 352 of the active member so that a longer high-frequency element can be positioned in the opening defined by the surface 361 as shown in FIG. 12.

In one form, the high frequency reciprocating area is in communication with the acoustic chamber. Alternatively, the high frequency reciprocating area could, in one form, have a separate chamber or be divided therefrom by a flexible membrane.

The material used in the high frequency area may be stronger, and stiffer than the material that comprises the reciprocating portion of the active member. In one form, where there is an exterior such as a thin carbon fiber layer that covers the outer surface of the active member 326 and the surrounding wall sections, the excavation of the interposed structure may be a thickness up to the inner surface of the outer material 362 as shown in FIG. 11 and an intermediate layer may not be employed. In one form of construction, a first adhesive protective layer is removed from a doubles sided adhesive sheet, and the two-sided adhesive sheet is adhered to one side of a sheet of high frequency material.

The high frequency area shapes may be produced from this combined assembly by cutting, punching, machining etc. A second protective layer may then be removed from the adhesive sheet, and the combined assembly is adhered to the active member.

It should be noted that when the final installation of an in-wall assembly in one form is complete as shown in FIG. 1, the speaker installation may not be visible, particularly when the active member has paint, wallpaper, or other graphics covering the outer surface.

Now referring to FIG. 13, there is shown yet another embodiment where an in-wall speaker system 420 comprises, as best shown in FIG. 14, a base frame 422, a speaker assembly 424, and an active member 426. As in previous embodiments, to ease in understanding, similar components having similar numerals are designated the same except increased by a value of four hundred (e.g. 20→420). As shown in FIG. 15, the high-frequency region 458 has a high-frequency sound element 502 attached thereto. As shown in the exploded view in FIG. 17, the high-frequency sound element 502 has a base region 506. The base region 506 is attached to the insert 513. As shown in FIG. 15, the insert has a stepped region 515 were the front portion 517 may extend slightly further inward from the rear baffle 434. Generally, the insert 513 allows for proper positioning of the high-frequency (the high-frequency driver) element 502.

Figure 17:
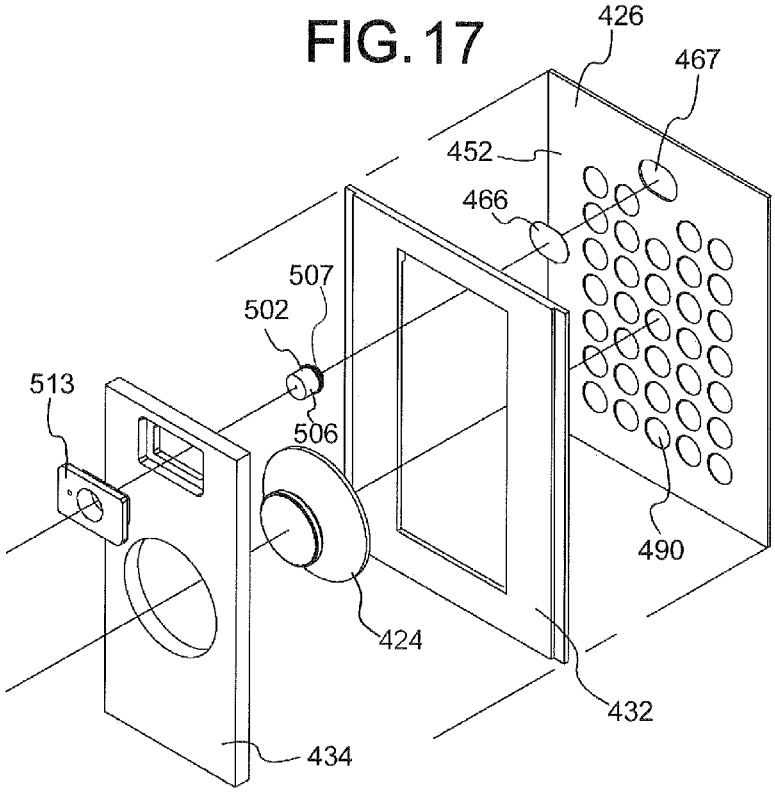
FIG. 17 shows an exploded view of another embodiment of a speaker system.

As shown in FIG. 17, the high-frequency insert 466 in this form is comprised of a piece of carbon fiber that may be approximately 1/100-1/32 of an inch thick. In a broader range, the carbon fiber is plus or minus 10-20% the thickness of the aforementioned range values. In some installations, the front edge 507 of the high frequency element 502 may be adhered to the high frequency insert 466 to further improve sound transmission thereto. As further shown in the embodiment of FIG. 17, there may be provided a recessed portion 467 adapted to have the high-frequency insert 466 inserted therein. As is further shown in FIG. 17, there is a plurality of flexibility regions 490 which in one form are recessed portions of the active member 426 on the interior surface portion 452. As mentioned above, in one form, the active member 426 is a foam core, PVC, expanded PVC, hardened fibrous material, or equivalents. The flexibility regions 490 are a plurality of regions that may be produced in a similar manner as the recessed portion 467 to allow the active member a greater amount of travel to transmit sound better and further maintain the structural integrity of the active member so the outer surface is a substantially planar surface with the surrounding wall, or in other words, does not have any noticeable indentations throughout the active member outer surface.

Figure 16:
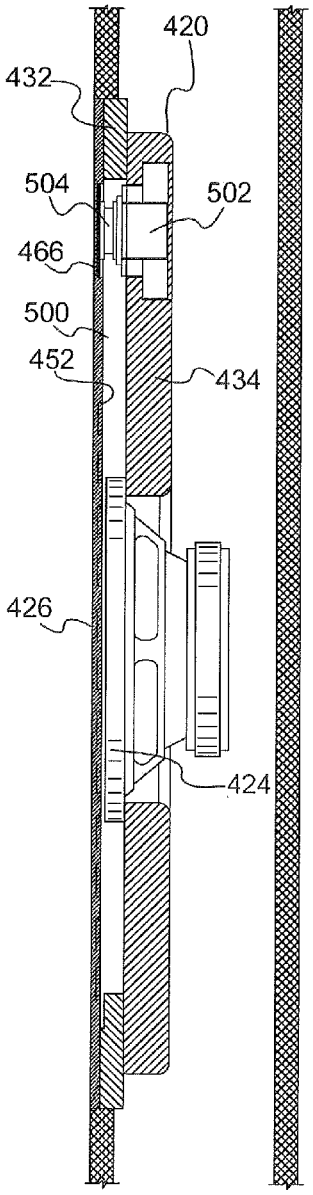
FIG. 16 shows a side partial cross sectional view of a speaker system.

FIG. 16 shows a side cutaway view of the one embodiment of the assembly 420 where it can be seen how the perimeter frame 432 and the baffle 434 aid in comprising the acoustic chamber 500. In this variation, the speaker assembly 24 is in close engagement with the inner surface 452 of the active member 426. As shown in the upper portion of this figure, the driver portion 504 of the high-frequency member/element 502 is in engagement with the active member 426 where in a preferred form, the carbon fiber high-frequency insert 466 is interposed therebetween and adhered to the active member 426 and/or the high-frequency member/element 502.

Figure 21:
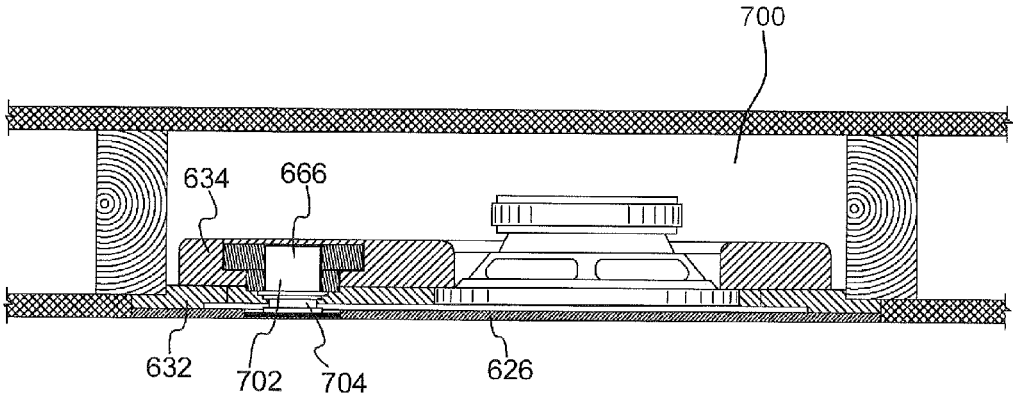
FIG. 21 shows a side partial cross sectional view of one embodiment of the disclosed speaker system.
Figure 22:
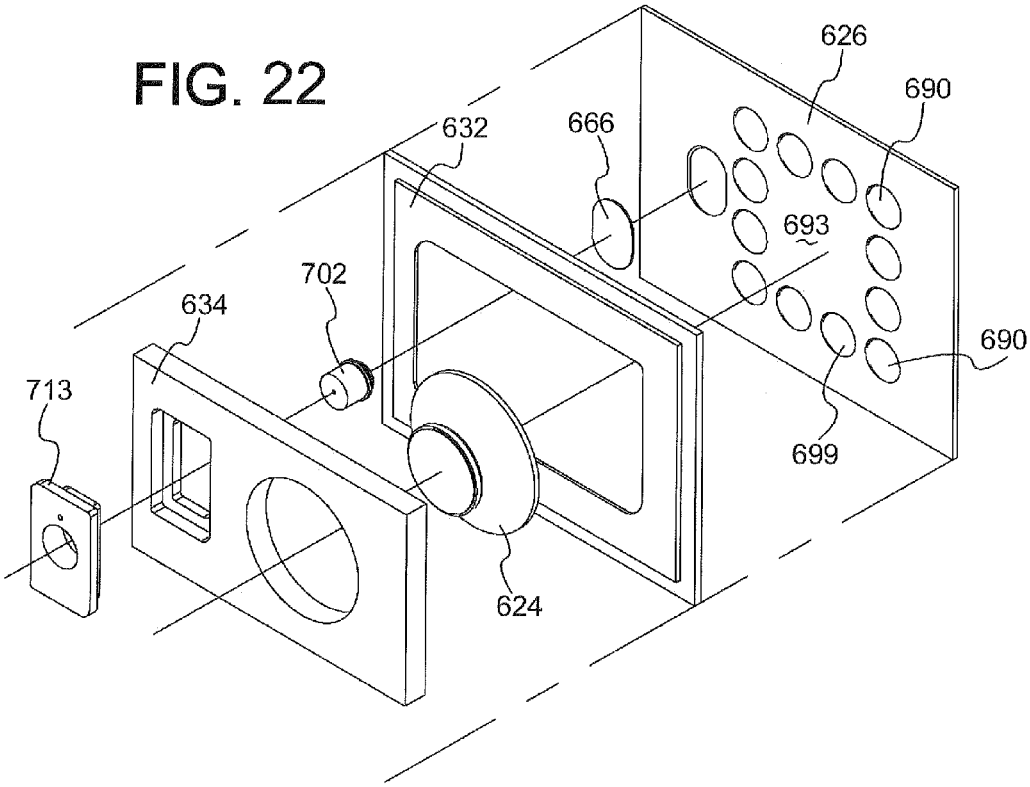
FIG. 22 shows the exploded view of an embodiment of an improved speaker system.

In FIG. 18, there is shown another embodiment where the speaker assembly 620 is shown in a hatched line behind a wall. This embodiment is similar to the previous embodiment shown in FIGS. 13-17, except in this form, the assembly is positioned in the lateral direction. As in previous embodiments, to ease in understanding, similar components having similar numerals are designated the same except increased by a value of six hundred (e.g. 20→620). As shown in FIG. 19, there is a cross-sectional view where the speaker assembly 624 is shown and the acoustic chamber 700 is minimized. Referring ahead to FIG. 22, it can be seen how this embodiment of the active member 626 has a plurality of flexible regions 690 which in one form are positioned around a perimeter portion 693. In this form, the central region 693 is left substantially intact and the perimeter flexible regions 690 allow for a certain amount of extra flexion of the central region 693 to aid in the transmission of sound from the speaker assembly 624. Still referring to FIG. 22, the high-frequency member 666 is similar to the insert 466 noted above. The high-frequency element 702 is attached in a like manner to an insert 713 of the base frame. As shown in FIG. 21, the high-frequency element 666 is shown in a partial sectional view where the active portion 704 is in engagement with the high-frequency portion of the active member 626. (See also FIG. 20.) In this embodiment, as shown in FIG. 19-22, the baffle member 634 and the perimeter frame portion 632 are shown. Various other forms of a frame-like portion can be utilized to form the acoustic chamber 700.

In general, the high-frequency sound element shown above as 502 can be a three-way full range device producing frequencies from 40 hertz to 20 kilohertz. The total radiating surface can be in the order of 480 square inches, and the active member can be a loudspeaker system having a sensitivity of 85 decibels, 1 watt, 1 meter, with a capacity of 150 watts (for example). This provides, in one form, a frequency response of the system between 40 hertz and 20 kilohertz.

Therefore, it can be appreciated that the elements of a base frame can comprise one or more members which are adapted to be attached to support structures such as studs or horizontally extending members such as support beams of the ceiling. The apparatus has inner surface defining an acoustic chamber that is in communication with a speaker assembly or other like air displacing sound producing device. Free standing embodiments including hanging embodiments will be described. Further, in one form an embodiment includes the excavation of the rearward portion of the active member and may include a step of placing a rigid thin material therein that is adapted to be operatively connected to a high-frequency member to produce higher frequency sounds as previously described. In one form the apparatus is mounted to a vertical wall with support studs; however, in the broader scope the apparatus can be utilized in ceiling surfaces and in such environments such as ceilings for porches and outdoor decks, and additionally in free-standing embodiments.

Figure 24:
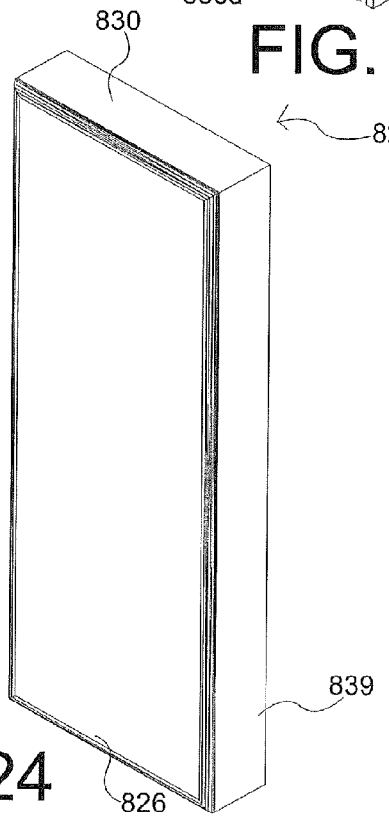
FIG. 24 shows an isometric view of a freestanding version of one embodiment of the disclosed speaker system.

FIG. 24 shows another embodiment where the speaker assembly 820 is shown as a free-standing embodiment. This version is similar to the previous embodiments in many aspects. As in previous embodiments, to ease in understanding, similar components having similar numerals are designated the same except increased by a value of eight hundred (e.g. 20→820).

Figure 23:
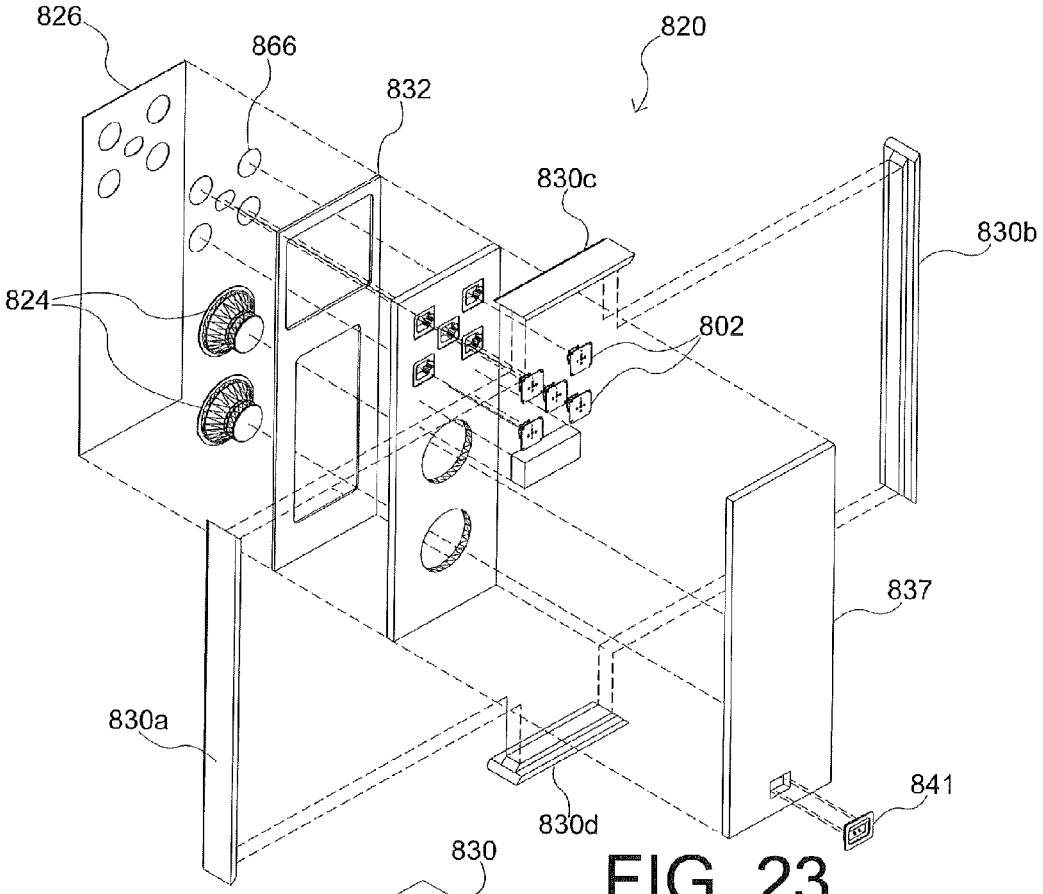
FIG. 23 shows an exploded view of an embodiment of one embodiment of the disclosed speaker system.

In the embodiment shown in FIGS. 23 and 24, the speaker system is shown installed between free standing support members 830*a* and 830*b*. In this embodiment, the acoustic chamber 839 is a free-standing chamber defined by support members 830*a* and 830*b*, as well as upper cross member 830*c* and a lower cross member 830*d*, as shown in FIG. 23. To complete the enclosure 832, an active member 826 and rear panel 837 are provided. While many different materials can be used, the enclosure can easily be built with the support members 830*a*-830*d* made from solid wood, such as poplar, or equivalent products and the rear panel made from wood, wood products, such as medium density fiberboard (MDF), non wood products, or equivalents. The front panel active member 826 may be produced of a series of layers and elements, as shown in FIGS. 5 and 17, and is described herein in some detail. In one embodiment, the active members 26 of FIG. 5, 426 in FIG. 17, 626 of FIG. 23, and 826 of FIG. 23 etc. are formed of PVC, expanded PVC, fiberglass, carbon fiber, and similar materials which provide an excellent waterproof surface face to the enclosure 532.

In one form, a latex contact adhesive is utilized to retain the graphic in position and retain the moisture resistant advantages of the active member. In one assembly method, the graphic is applied to the active member, and then the combined assembly is shaped to the desired shape and size. In this way, the high frequency response of the system is maintained.

In one form, the entire acoustic chamber 839 may be formed of a watertight box made of synthetic, waterproof materials. A speaker terminal connection 841, as shown in FIG. 23, may be the only opening to the interior portion of the watertight box, and may itself be watertight. This arrangement is particularly suited to wet (humid) environments, and marine applications.

In one form, a product made by the Kommerling® Company called Komatex® has been utilized as the PVC layer with exceptional results, although other PVC and expanded PVC sheet materials can also be utilized.

Figure 25:
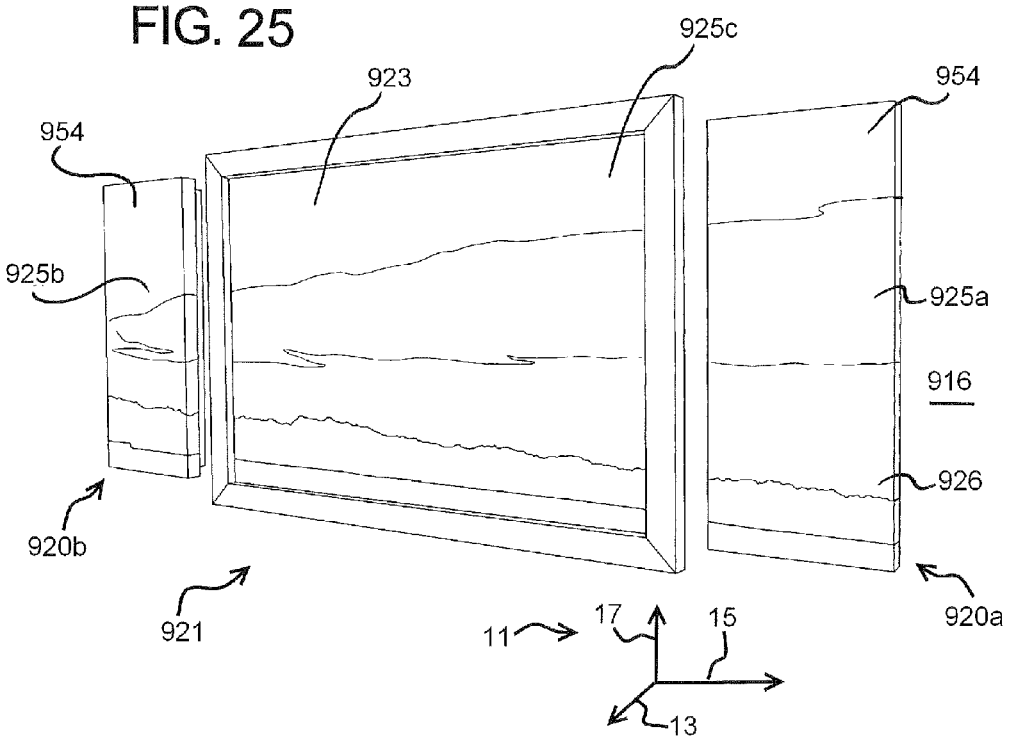
FIG. 25 shows an isometric view of an embodiment of the speaker system in combination with a video screen.

Looking to FIG. 25, an improved speaker arrangement 921 is shown which incorporates many of the features previously discussed. As in previous embodiments, to ease in understanding, similar components having similar numerals are designated the same except increased by a value of nine hundred (e.g. 20→920). In addition, specific embodiments of a general element will have an alphabetic suffix. For example, a speaker system is generally denoted as 920, which for example may indicate either a left speaker system 920A, or a right speaker system 920B. The term speaker system includes the speakers themselves, as well as the supporting and other attached structural members. As shown, the outer surface 954 of each speaker system 920 (A or B) has a graphic image produced thereon to improve the aesthetic value of each speaker system, and the speaker arrangement as a whole. The speaker arrangement including a plurality of speaker systems, and may include a non-static visual device such as described below. Each speaker system comprising an active member as described above, defining the face of the speaker system generally facing away from the adjacent wall surface or surrounding region 916.

The graphic image provided on each speaker system may not only extend to substantially cover the front surface 954 of each speaker system, but may wrap around the sides, bottom, and/or top of the speaker in what is often termed a "gallery wrap" to further increase the aesthetic value of each speaker system, and the speaker arrangement.

To increase the quality of a television or in-home non-static visual experience, it may be desired to have a speaker arrangement 921 with speaker systems 920 on at least either side of the display portion 932 of an electronic video projection apparatus such as a television, computer monitor, or other graphic display. Additional speaker systems may be employed for example to increase a stereo or surround sound effect. As previously described, speaker systems have traditionally been less than visually desirable in a room due to their extension from the surrounding surface, and color mis-coordination. Most commonly, the surface covering the speaker portion of the speaker system has been foam, fabric, mesh, or similar porous material to allow sound to travel therethrough unimpeded. As such, an improvement is conceived wherein the speakers have a graphic image 925A or 925B produced thereon, but a novel assembly and material are utilized to allow a continuous image to be produced on the exterior of each speaker system. In one form, the image can be produced seamlessly, without any air vents, holes, or other discontinuations in the image. The graphic image may be painted, engraved, printed, silkscreened, or otherwise produced upon the face of the active member. While previous attempts have been made to hide speakers in this way, such as defined in U.S. Pat. No. 3,848,090, the sound quality produced by such a device was so hindered by the arrangement, that the final product was generally not desired by consumers. Similarly, painted porous speaker grills such as found in U.S. Pat. No. 5,412,162 were generally visually un-appealing and resulted from similar user (customer) dissatisfaction.

The prior shortcomings have been overcome in one form through the novel combination of the panel (active member) described above, in combination with a graphic image produced on the face (and possibly sides and/or top) of the active member. The speakers and the active member are attached to a base frame in such a way that the active member with the graphic image produced thereon is an active part of the sound producing system as described in the previous section.

With the relatively recent invention and proliferation of video projection devices such as large flat screen televisions, televisions are now often attached to an interior wall to look like paintings, posters, or other wall art, even when not used for viewing moving images. In such applications, it may be desired to use the television as part of the interior decorations while "idle" by using a still image, or possibly an image taken by a still camera such as a landscape displayed on the television as art. As such, it is conceived that the image displayed on the television may cooperate with the image(s) produced on adjacent speaker systems 920. By way of example, the center image 925C of FIG. 25 is a digital image which may be turned off, or changed to any image desired by the viewer. The fixed images 925A and 925B produced on the speaker systems 920A and 920B however may not change. Thus, when a television show, movie, or other visual is produced on the center image 925C, the adjacent images would most likely not cooperate therewith. However, the images 925A and 925B would most likely be chosen to be individually pleasing by themselves.

In another embodiment, the center image 925C is not an electronic image, but a view through a window or doorway. For example, wherein a window opens out to a field, the images produced on the adjacent speakers could be static images of the field, adjacent the portion of the field seen through the window. While weather, plant conditions, etc. may not always be correctly presented, the general impression could me maintained.

Figures 26, 27, 28:
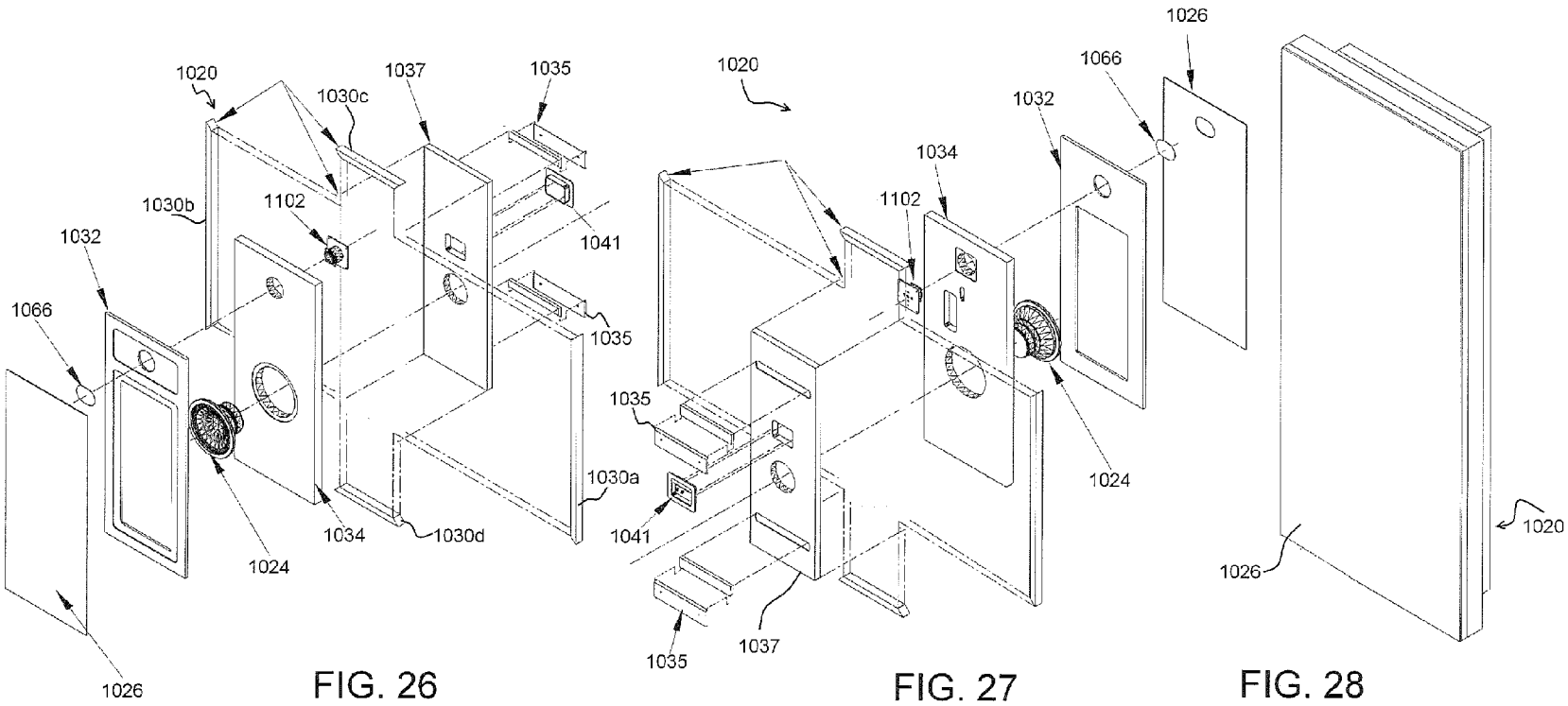
FIG. 26 is an exploded view of one embodiment of the embodiment shown in FIG. 25.
FIG. 27 is a reverse angle view of the embodiment of FIG. 26.
FIG. 28 is an assembled view of the embodiment of FIG. 26.

Looking to FIGS. 26-28, an improved speaker arrangement 1021 is shown which incorporates many of the features previously discussed. As in previous embodiments, to ease in understanding, similar components having similar numerals are designated the same except increased by a value of a thousand (e.g. 20→1020).

As can be understood, this assembly may result in the speakers 920 of FIG. 25. As shown, an active panel 1026 is proved which may be produced of the materials disclosed above, or as previously mentioned, a hardened fibrous material such as fiberglass, carbon fiber, or equivalents set in hardened resin, polyurethane, epoxy, or functional equivalent materials. Testing of these materials has shown dramatic acoustic improvements when such a panel is used, and the material is much more resilient to temperature and humidity fluctuations than several prior tested materials.

Looking to FIGS. 26 and 27, it can be seen how the speaker system 1020 in one form may be assembled by attaching a high frequency insert 1066 thereto. Testing of thin hardened fiberglass and hardened carbon fiber panels has shown that the inserts 1066 may not significantly affect the sound quality of the speaker system 1020 when the active member is produced of a hardened fibrous material. A low frequency driver 1024 may be attached to a speaker baffle 1034 along with a med/high frequency driver 1102. This assembly may then be attached by fasteners, adhesives etc to the rear face of a speaker frame 1032 which may in turn be attached to the rear face of the active member 1026. A frame 1030 comprised of frame members 1030*a-d* may be assembled and then attached to the rear face of the speaker baffle 1034. A speaker back 1037 may be attached thereto and may have a speaker terminal connection 1041 attached thereto for external electrical signal connection to a sound signal source such as a stereo. In addition, a plurality of wall brackets 1035 may be utilized for attachment to nails, screws, cleats, or other projections from a wall or equivalent vertical surface.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. An improved speaker arrangement operatively configured to be concealed and mounted to a surrounding surface, the speaker arrangement comprising:

a. at least one speaker system housing a speaker;

b. a base frame having an open area and a perimeter region;

c. the speaker assembly mounted to the base frame, the speaker assembly having a reciprocating portion adapted to move in response to an audio input signal;

d. an active member having a peripheral region, the active member connected to the base frame;

e. the active member having an outward surface and an inward surface;

f. wherein the base frame, the active member, and the speaker assembly in conjunction define an acoustic chamber, whereby acoustic energy is transferred from reciprocating member of the speaker to the active member so that the outward surface of the active member transmits the acoustic energy as sound;

g. the inward surface of the active member further comprises a high-frequency region comprised of a high-frequency inward surface mounted to the driver portion of a high-frequency element;

h. where the inward surface of the active member comprises a low-frequency region, the high-frequency region attached to the driver portion of the high frequency element within the acoustic chamber;

i. the high frequency element comprising the driver portion attached to the high frequency region and a base region;

j. whereas the outward surface of the active member is operatively configured to be substantially contiguous with the surrounding surface;

k. where the base region of the high-frequency element is attached to the base frame;

l. where the inward surface of the active member has a high-frequency region having a high-frequency inward surface mounted to the driver portion of the high-frequency element; and m. comprising a speaker graphic image produced on the outward surface of the active member.

2. The improved speaker arrangement as recited in claim 1 wherein the active member is formed of a hardened fibrous material which comprises fiberglass strands.

3. The improved speaker arrangement as recited in claim 1 wherein the active member is formed of a fibrous material which comprises carbon fiber strands.

4. The improved speaker arrangement as recited in claim 1 further comprising:

a. the speaker system attached to a wall in a vertical plane;

b. an electronic video projection apparatus laterally adjacent the speaker system in the same vertical plane;

c. a video graphic image produced upon the electronic video projection apparatus; and d. wherein the speaker graphic image visually coordinates with the video graphic image.

5. The improved speaker arrangement as recited in claim 4 wherein the speaker graphic image is a visual extension of the video graphic image.

6. The improved speaker arrangement as recited in claim 4 further comprising a second speaker adjacent the electronic video projection apparatus.

7. An improved speaker arrangement concealed in a room, the improved speaker arrangement comprising:

a. a speaker system comprising a base frame having rearward portions and speaker frame portions b. a reciprocating portion having a peripheral region mounted to the speaker frame portions, and a driver adapted to move the reciprocating portion;

c. an active member formed of a hardened fibrous material having a perimeter region mounted to the base frame where the active member has an outer surface and an inward surface where the inward surface of the active member has a high-frequency region and further where the inward surface, the base frame, and the reciprocating portion define an acoustic chamber adapted to transmit energy from the reciprocating portion to the active member;

d. a high-frequency system where a high-frequency element positioned within the acoustic chamber and having a driver portion and a base region where the driver portion is mounted to a high-frequency reciprocating area of the active member and the base region is mounted to a non high-frequency reciprocating area of the speaker system.

* * * * *